US005203382A

United States Patent [19]

Barnhart et al.

[11] Patent Number: 5,203,382

[45] Date of Patent: Apr. 20, 1993

[54] COMBINATION PIN STRAIGHTENER AND PIN SPREADING DEVICE

[75] Inventors: Robert T. Barnhart, 1329 N. Columbus Ave. #C, Glendale, Calif. 91202; Kent S. McFann, Los Angeles, Calif.

[73] Assignee: Robert T. Barnhart, Hollywood, Calif.

[21] Appl. No.: 818,604

[22] Filed: Jan. 9, 1992

[51] Int. Cl.[5] ..... B21F 1/02

[52] U.S. Cl. ..... 140/123; 140/147

[58] Field of Search ..... 140/102.5, 106, 123, 140/147; 72/458, 477, 479; 7/107, 108

[56] References Cited

U.S. PATENT DOCUMENTS

| | | | |
|---|---|---|---|
| 619,651 | 2/1899 | Adams | 72/479 |
| 1,958,673 | 5/1934 | Newcomb | 140/102.5 |
| 3,417,603 | 12/1968 | Loew | 72/479 |
| 4,416,143 | 11/1983 | Fouroux et al. | 72/479 |

*Primary Examiner*—Lowell A. Larson

[57] ABSTRACT

A tool used for straightening and spreading damaged electrical stage pin connectors. The tool consists of a handle and a tube which form a T-shape, there are two opposing holes on the handle for strightening bent pins with one end of the handle being tapered for tight fits. The tube embodies a blade affixed in the bottom of the tube and recessed from the mouth of the tube for prevention of laceration.

6 Claims, 2 Drawing Sheets

FIG. 1
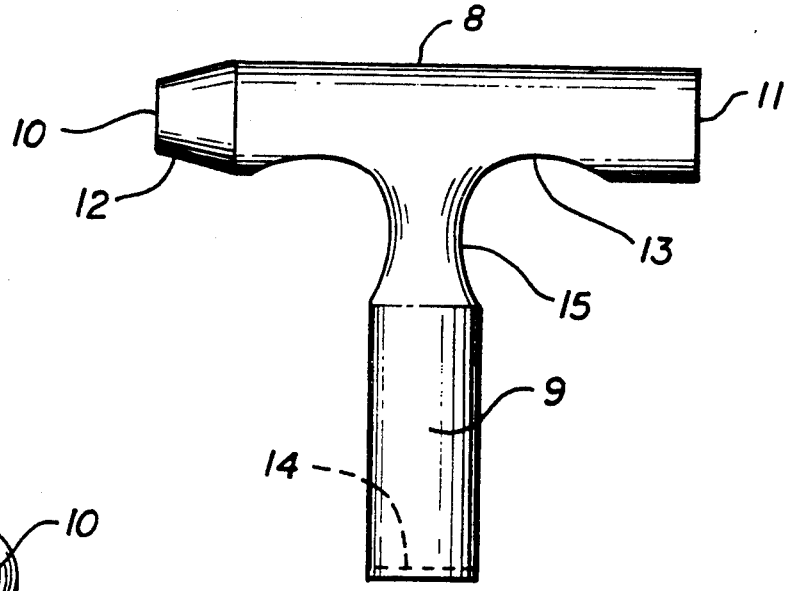
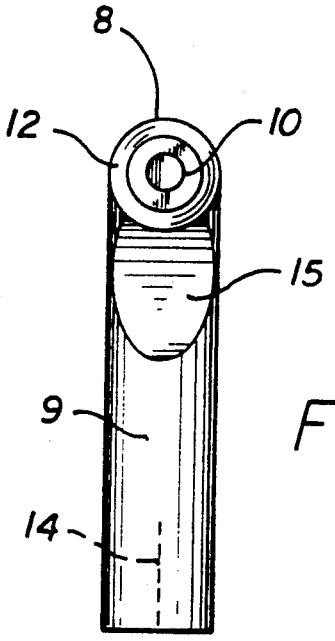
FIG. 2
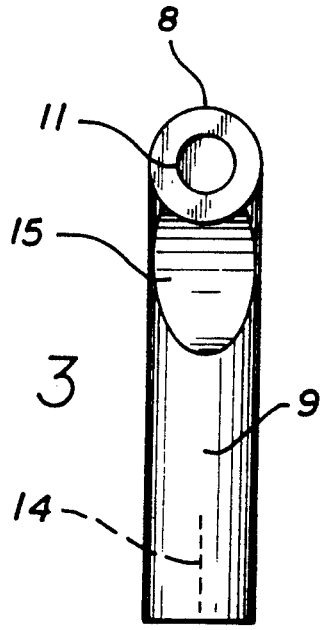
FIG. 3
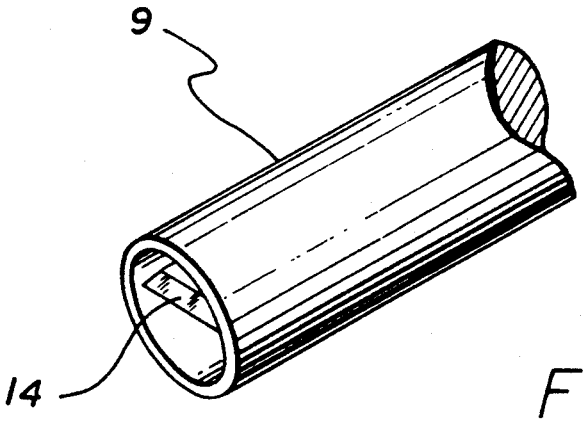
FIG. 4

COMBINATION PIN STRAIGHTENER AND PIN SPREADING DEVICE

SUMMARY OF INVENTION

A tool that is a combination pin straightener and pin spreader to provide a safe, reliable means in a multifaceted easy to handle tool for performing maintenance on stage pin connectors. The tool is comprised of a T-shaped member defining a handle and tube. The handle includes two opposing holes with one end of the handle tapered. The tube which is affixed perpendicularly to the handle includes a blade recessed in the bottom of the tube and affixed parallel to the handle. Both the handle and the tube have finger notches where they intersect.

BACKGROUND OF INVENTION

A. Field of Invention

This invention relates to electrical connector maintenance and repair. In particular to a tool for straightening and spreading electrical contacts, particularly stage pin connectors commonly used in the entertainment industry.

A stage pin connector is typically made of non conductive material fitted with three brass inserts on the receptacle and three matching brass pins on the plug, these brass pins are inserted into the receptacle making electrical contact, the tension in the contact is maintained by a split down the center of each pin on the plug this split makes the pin slightly larger than the inserts causing a solid electrical contact by means of frictional force between the pins and brass inserts. Stage pins come in a variety of sizes ranging from twenty amps to one hundred amps.

B. Description of Prior Art

Previous methods for repairing damaged connectors have been performed by using an exposed blade such a a pocket knife to reestablish the split in the damaged pin. this procedure is both difficult and inaccurate given the large variety of pocket knife blades, it also poses the danger of laceration because of the downward pressure required to split the pin which is the only object between the blade and the hand holding the damaged connector. The most commonly used method of realigning the bent pin is to insert the damaged pin into one of the receptacle inserts and using that receptacle as a leverage arm to bend the damaged pin back to its normal position. Although this is a consistent means of repair it is both inconvenient and dangerous because of potential electrical shock.

It is therefore, a principal object of this invention (do to the high replacement costs of the above mentioned connectors and the dangers imposed trying to maintain said connectors) to provide an apparatus for restoring said connectors to a usable condition which is safe, efficient and economical to the user.

Other objects are to provide a means of increasing the users leverage when splitting pins and eliminating the hazard of lacerations do to an exposed blade.

Another object is to provide a tool with sufficient leverage as means of straightening a variety of the most commonly used pins therefor making a better use of the operators time and eliminating the present dangers.

Still another object is to provide a tool that will straighten a pin that has been bent towards another pin leaving very little clearance between the two said pins.

Another principal object is to provide all the above mentioned objects in one tool which provides the operator with a firm, comfortable and safe grip while performing the needed maintenance.

These and other objects and features of the present invention will become apparent to those skilled in the art from a consideration of the following drawings and claims. The description along with the accompanying drawings provide a selected example of construction of the device to illustrate the invention.

BRIEF DESCRIPTION OF THE DRAWINGS

This invention will now be described with reference to the accompanying drawings in which:

FIG. 1 is a front elevation;

FIG. 2 is a side 1 view;

FIG. 3 is a side 2 view;

FIG. 4 is a bottom view;

DETAILED DESCRIPTION OF THE PREFERRED EMBODIMENT

Figure 5:
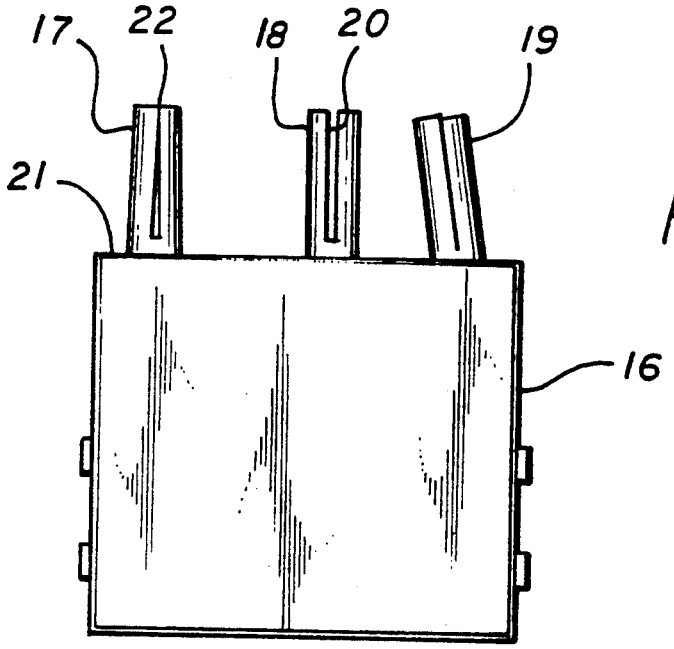
FIG. 5 illustrates a connector with correct and incorrect pins.

Referring now to the drawings:

In the illustrated preferred embodiment, the pin straightener and splitting tool, shown generally in FIG. 1 includes a handle (8) and a tube (9) which is preferably formed of a one-piece unitary member that may be about one quarter inch to two inches in thickness. The tool may be made of suitable metal, such as steel, by casting or forging; or it may by machined in two separate pieces (8) and (9) and welded together; or it may be made by molding from a high impact plastic material such as polycarbonate or ABS. The configuration of the tool is such that it lends itself to easy manipulation and highly effective operations throughout its travel. Primarily it consists of a round handle (8) which has two opposing holes at either end (10) and (11) shown in FIG. 2 and FIG. 3, these holes can be of any diameter ranging from one eighth inch to about one inch and can be of any depth ranging from a quarter inch to four inches. These holes are primarily for straightening the bent pins (19) Shown in FIG. 5. One end of the handle (8) is tapered (12), the reduced portion of the handle (12) may be of any dimension of configuration, but is shown in the form of a taper (12), thus permitting it to fit over bent pins (19) as in FIG. 7 that have come to rest at at a narrow distance from another pin (18). Two notches (13) are incorporated on the handle (8) were the tube (9) intersects with the handle, these notches serve as finger grips for increased safety and comfort in handling.

The tube (9) in FIG. 1 and 4 embodies a blade (14) which can be made to any dimension but is shown in the form of a knife blade and is recessed within the tube to prevent lacerations. The blade (14) functions as the splitting device for the damaged stage pins FIG. 5 and 6 (17) . The blade in this illustrated preferred embodiment is affixed parallel to the handle but could function at any position, and can be affixed in many ways such as welding, bolting or set screw. Two notches (15) are also incorporated in the tube were the handle runs across perpendicularly, the indentations are designed for increased comfort and stability for the user.

The pins to be repaired are part of a connector FIG. 5. The assembly (16) usually consists of three pins (17,

18, 19) all of which have a split (20) down the center and are embodied (by a non conductive material (16) along the same face (21). In this illustration a pin (17) is shown with an improper split (22). Another pin (19) is shown bent over, both pins (17, 19) are an illustration of common damage found on stage pin connectors. Both pins need to be corrected to resemble and run parallel to the middle pin (18) shown in FIG. 5, before the connector can be used. It is understood that the omitted members as well as the hidden parts of the assembly are not fully described herein because they form no part of the invention.

Figure 7:
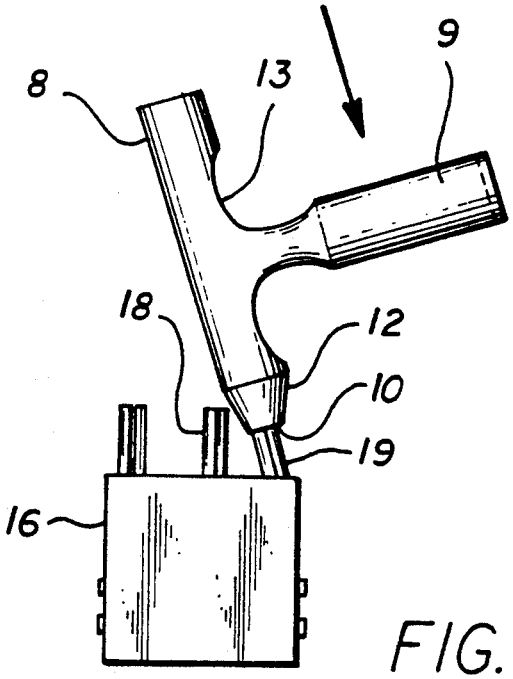
FIG. 7 illustrates the use of the tool for straightening bent pins.

When a pin is to be repaired it must first be straightened, this is done by a series of steps preferably shown in FIG. 7. The proper hole (10 or 11) in the handle (8) of the tool is inserted over the damaged pin (19) and by griping the tube (9) in one hand and the connector (16) in to other hand, and applying pressure down on the tube the bent pin can be brought back to an upright position to match the other pins as shown in FIG. 5 as pin (18). The tapered (12) end of the handle (8) has been incorporated in this tool for those pins FIG. 7 that have bent towards another pin (18), these pins are straightened in the same procedure as discussed above.

Figure 6:
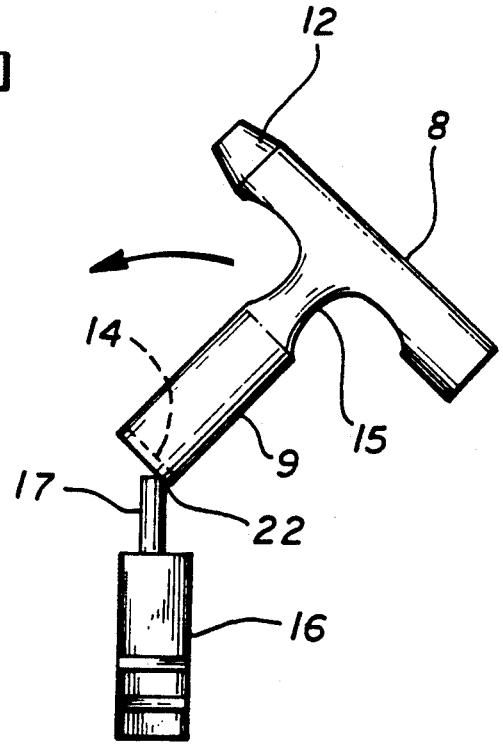
FIG. 6 illustrates the use of the tool for splitting pins.

FIG. 6 illustrates the use of the pin splitting portion of the tool. In this embodiment of the pin splitting process the blade (14) is placed at an angle on top of the closed gap (22) then by applying downward pressure with the tool the split can be reestablished, the blade can then be removed from the pin. It may become necessary to initiate a slight turning action with the handle (8) once the blade has entered the damaged pin to establish the required gap, this will depend on the blade size and the size of pin to be repaired.

It can thus be seen that our novel tool provides a safe, useful and versatile device and method for straightening and splitting damaged stage pin connectors. The invention has been described in the form of a preferred embodiment, but such is not intended to be limiting, and other forms of the invention are considered to be within the scope thereof.

We claim:

1. A tool for straightening and splitting stage pin connectors, wherein a handle incorporating two holes, one at each end, with one end of the handle being tapered, is perpendicular and attached to one end of a tube, leaving the other end of the tube open to form a mouth, which embodies a blade (at the bottom which is) recessed within the said mouth of (said) the tube.

2. The tool of claim 1 further comprising of four notches: two in the handle on either side of the attached tube, (at the intersection of the tube,) and two in the tube on opposite sides of each other, where the tube attaches to the handle. (at the intersection of the handle.)

3. The tool of claim 1 in which said (T-shaped handle) tool is made of metal.

4. The tool of claim 3 in which said metal is steel.

5. The tool in claim 1 in which said tool is made of a high impact-resistant plastic.

6. The tool of claim 5 which said plastic is polycarbonate.

* * * * *